US008327736B2

(12) United States Patent
Park

(10) Patent No.: US 8,327,736 B2
(45) Date of Patent: Dec. 11, 2012

(54) ACCELERATOR PEDAL DEVICE WITH VARIABLE PEDAL EFFORT

(75) Inventor: Hangil Park, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 360 days.

(21) Appl. No.: 12/606,806

(22) Filed: Oct. 27, 2009

(65) Prior Publication Data

US 2010/0139444 A1 Jun. 10, 2010

(30) Foreign Application Priority Data

Dec. 5, 2008 (KR) ..... 10-2008-0123385

(51) Int. Cl.
*G05G 1/30* (2008.04)

(52) U.S. Cl. ..... 74/513

(58) Field of Classification Search ..... 74/512, 74/513, 560

See application file for complete search history.

(56) References Cited

U.S. PATENT DOCUMENTS 5,568,797 A * 10/1996 Landerretche ..... 123/396
2001/0011487 A1* 8/2001 Kojima et al. ..... 74/513

FOREIGN PATENT DOCUMENTS

JP 01092537 A * 4/1989
JP 2007137152 A * 6/2007
KR 10-0644796 B1 11/2006
KR 10-2007-0061713 A 6/2007

* cited by examiner

*Primary Examiner* — Vicky Johnson
(74) *Attorney, Agent, or Firm* — Morgan, Lewis & Bockius LLP

(57) ABSTRACT

An accelerator pedal device with variable pedal effort, may include an elastic member that applies a restoring force in a return direction to an accelerator pedal rotatably coupled to a vehicle body, at least a pedal effort providing elastic member coupled to the vehicle body and providing a pedal effort in an operation direction of the accelerator pedal, and at least a locking pin mounted to the vehicle body and being selectively engaged with at least one of the at least a pedal effort providing elastic member to disable an operation of the selected pedal effort providing elastic members to adjust sequentially the pedal effort of the accelerator pedal.

3 Claims, 3 Drawing Sheets

ACCELERATOR PEDAL DEVICE WITH VARIABLE PEDAL EFFORT

CROSS-REFERENCE TO RELATED APPLICATION

The present application is based on, and claims priority from, Korean Application Serial Number 10-2008-0123385, filed on Dec. 5, 2008, the disclosure of which is hereby incorporated by reference herein in its entirety.

BACKGROUND OF THE INVENTION

1. Field of the Invention

The present invention relates to an accelerator pedal, particularly an accelerator pedal with variable pedal effort that makes a driver recognize a danger to maintain safe traveling by changing the pedal effort of the accelerator pedal in accordance with a difference in distance or speed from the vehicle ahead.

2. Description of Related Art

Accelerator pedals of vehicles in the related art have a pedal arm pivotably connected to the vehicle body and a pedal pad attached with a large area to one end of the pedal arm to enable a driver to easily operate the accelerator pedal with a foot, and the other end of the pedal arm is connected to a throttle valve of the engine by a cable. Accordingly, as the driver operates the accelerator pedal with a foot, the accelerator pedal pivots and the throttle valve opens in proportion to the pivot amount, such that the amount of intake air flowing into the engine is adjusted.

With the accelerator pedal pivotably connected to the vehicle body, a return spring is provided such that the pedal can easily return to the initial position when the driver releases the accelerator pedal after operating the accelerator pedal.

However, since the return spring has a constant elastic modulus and applies an elastic force, which linearly increases in proportion to the displacement, to the accelerator pedal, the pedal effort of the accelerator pedal changes in accordance with the traveling conditions of the vehicle, such that it is insufficient to achieve a function of appropriately warning the driver.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an accelerator pedal device with variable pedal effort that prevents a danger of a traffic accident due to excessive acceleration and allows a driver to safely drive a vehicle by warning the vehicle, by changing the pedal effort of the accelerator pedal when the vehicle speed exceeds a limit speed or the vehicle is too close to a vehicle ahead while the vehicle travels, such that there is a danger of a traffic accident.

In an aspect of the present invention, the accelerator pedal device with variable pedal effort, may include an elastic member that applies a restoring force in a return direction to an accelerator pedal rotatably coupled to a vehicle body, at least a pedal effort providing elastic member coupled to the vehicle body and providing a pedal effort in an operation direction of the accelerator pedal, and at least a locking pin mounted to the vehicle body and being selectively engaged with at least one of the at least a pedal effort providing elastic member to disable an operation of the selected pedal effort providing elastic members to adjust sequentially the pedal effort of the accelerator pedal.

The at least a pedal effort providing elastic member may include a compression spring.

One end portion of the at least a locking pin may be integrally connected to a rotary shaft of an actuator mounted to the vehicle body and the other end portion thereof may be sequentially engaged with the selected pedal effort providing elastic members by rotation of the rotary shaft so as to prevent the operation of the selected pedal effort providing elastic members to increase the pedal effort.

The at least a locking pin may be spaced with a predetermined angle therebetween in a circumferential direction on the rotary shaft of the actuator to be sequentially engaged with the at least a pedal effort providing elastic member by rotation of the rotary shaft.

In another aspect of the present invention, the accelerator pedal device with variable pedal effort may further include an electronic control unit that detects a vehicle speed and a distance from a vehicle ahead, and drives the actuator in a case that the vehicle speed exceeds a predetermined vehicle speed and/or the inter-vehicle distance exceeds a predetermined inter-vehicle distance.

A hinge shaft fixed to the accelerator pedal may be pivotally connected to a mounting bracket fixed to the vehicle body, wherein the elastic member is disposed between one side of the mounting bracket and one end portion of the accelerator pedal, wherein a pedal effort providing link is integrally connected to the hinge shaft and is disposed along the one end portion of the accelerator pedal, and wherein the at least a pedal effort providing elastic member is positioned between the pedal effort providing link and the other side of the mounting bracket, one end portion of the at least a pedal effort providing elastic member being connected to the mounting bracket.

According to various aspects of the accelerator pedal device with variable pedal effort of the present invention, while a vehicle travels, the electronic control unit detects in real time the vehicle speed and the distance from a vehicle ahead and, when the present vehicle speed exceeds a limit speed set by the driver or the vehicle is too close to the vehicle ahead, warns a driver in operating the accelerator pedal such that the driver recognizes a difference in operational force from a common case when operating the accelerator pedal by applying an elastic force of the spring that causes change of the pedal effort to the accelerator pedal, in accordance with the excess amount and the close amount, thereby allowing the driver to safely drives the vehicle and reducing a danger of a traffic accident due to overspeed.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
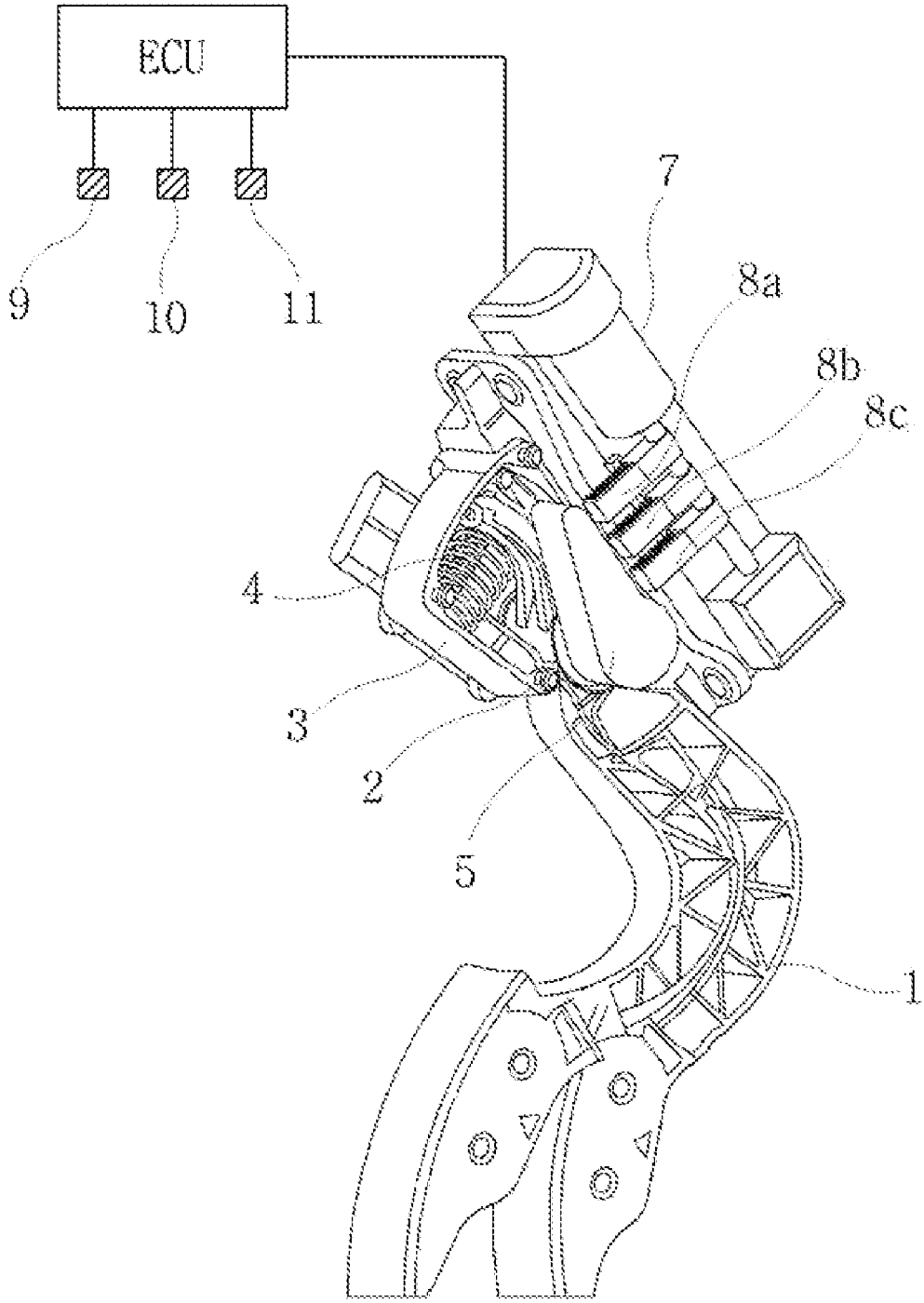
FIG. 1 is a perspective view of an accelerator pedal device with variable pedal effort according to an exemplary embodiment of the present invention.
Figure 2:
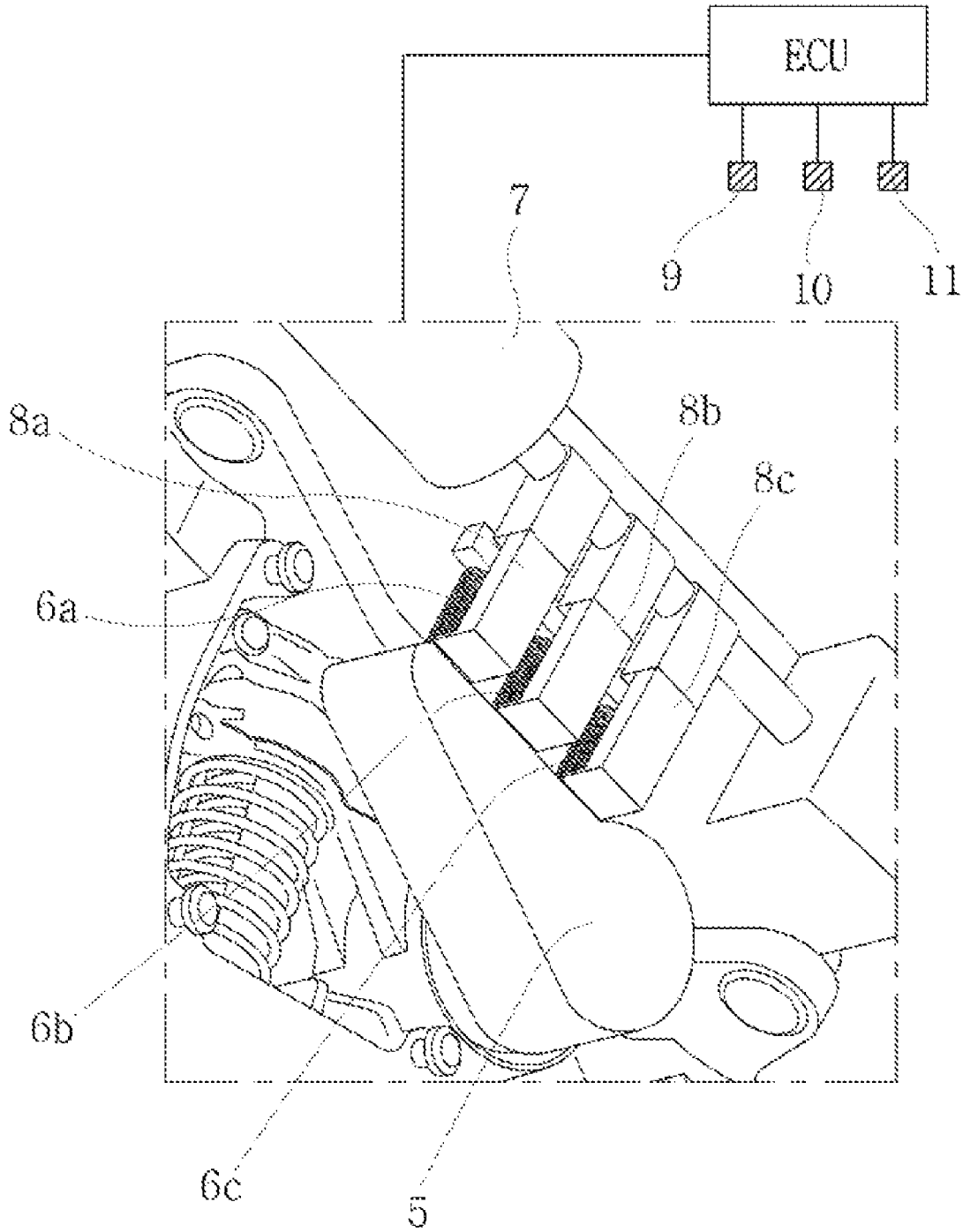
FIG. 2 is an enlarged perspective view of the main parts of FIG. 1.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 1, an accelerator pedal 1 is pivotably mounted to a mounting bracket 3 by a hinge shaft 2 inserted to integrally rotate, and a return spring 4 elastically supporting accelerator pedal 1 is disposed between one end of accelerator pedal 1 and mounting bracket 3.

Accordingly, return spring 4 stores an elastic return force while retracting by operation of the accelerator pedal, and then returns the accelerator pedal using the elastic return force when accelerator pedal 1 is released.

Return spring 4 is a coil spring having a constant elastic modulus, which applies an elastic restoring force, which is proportional to the operation stroke of the accelerator pedal, to the accelerator pedal.

One end of a pedal effort providing link 5 is integrally rotatably connected to hinge shaft 2, ends of a plurality of compression springs 6*a*, 6*b*, 6*c* are placed on and supported by pedal effort providing link 5 and the other ends of compression springs 6*a*, 6*b*, 6*c* are supported against mounting bracket 3.

Compression springs 6*a*, 6*b*, 6*c* are contracted and disposed between pedal effort providing link 5 and the mounting bracket, such that they apply sub-pedal effort that pivots accelerator pedal 1 in the operational direction through hinge shaft 2.

That is, the compression springs assist the driver's pedal effort when the driver operates the accelerator pedal, such that the operation pedal effort of the accelerator pedal is reduced.

A driving motor 7 is fixed to mounting bracket 3 and a plurality of locking pins 8*a*, 8*b*, 8*c* is integrally rotatably connected to a rotary shaft of driving motor 7, in which ends of locking pins 8*a*, 8*b*, 8*c* are integrally rotatably fixed to the rotary shaft, whereas the other ends are disposed to pivot toward compression springs 6*a*, 6*b*, 6*c* and lock to compression springs 6*a*, 6*b*, 6*c*.

Locking pins 8*a*, 8*b*, 8*c* are disposed at predetermined angles (e.g. 10°) in the circumferential direction on the rotary shaft, such that they are locked one by one to the compression springs while the rotary shaft rotates.

Although, three compression springs and three locking pins are shown in an embodiment of the present invention, they are not limited thereto and one or more can be provided.

Driving motor 7 is connected to the output terminal of an electronic control unit (ECU) to control driving of motor 7, such that the rotary shaft is rotated at a predetermined angle by a control electric current that is applied from the electronic control unit. Further, a vehicle speed sensor 9 that detects and inputs the vehicle speed, an inter-vehicle distance sensor 10 that detects and inputs the distance between vehicles, and a limit speed input switch 11 that enables a driver to input limit speed are connected to the input terminal of the electronic control unit.

Accordingly, with the accelerator pedal supported by return spring 4 and compression springs 6*a*, 6*b*, 6*c*, a driver presses down the accelerator pedal as much as the difference between the restoring force of the return spring and the pedal effort provided by the compression spring to operate the accelerator pedal, in which the operation pedal effort applied to the accelerator pedal by the driver increases in proportion to the operation stroke of the accelerator pedal.

Figure 3:
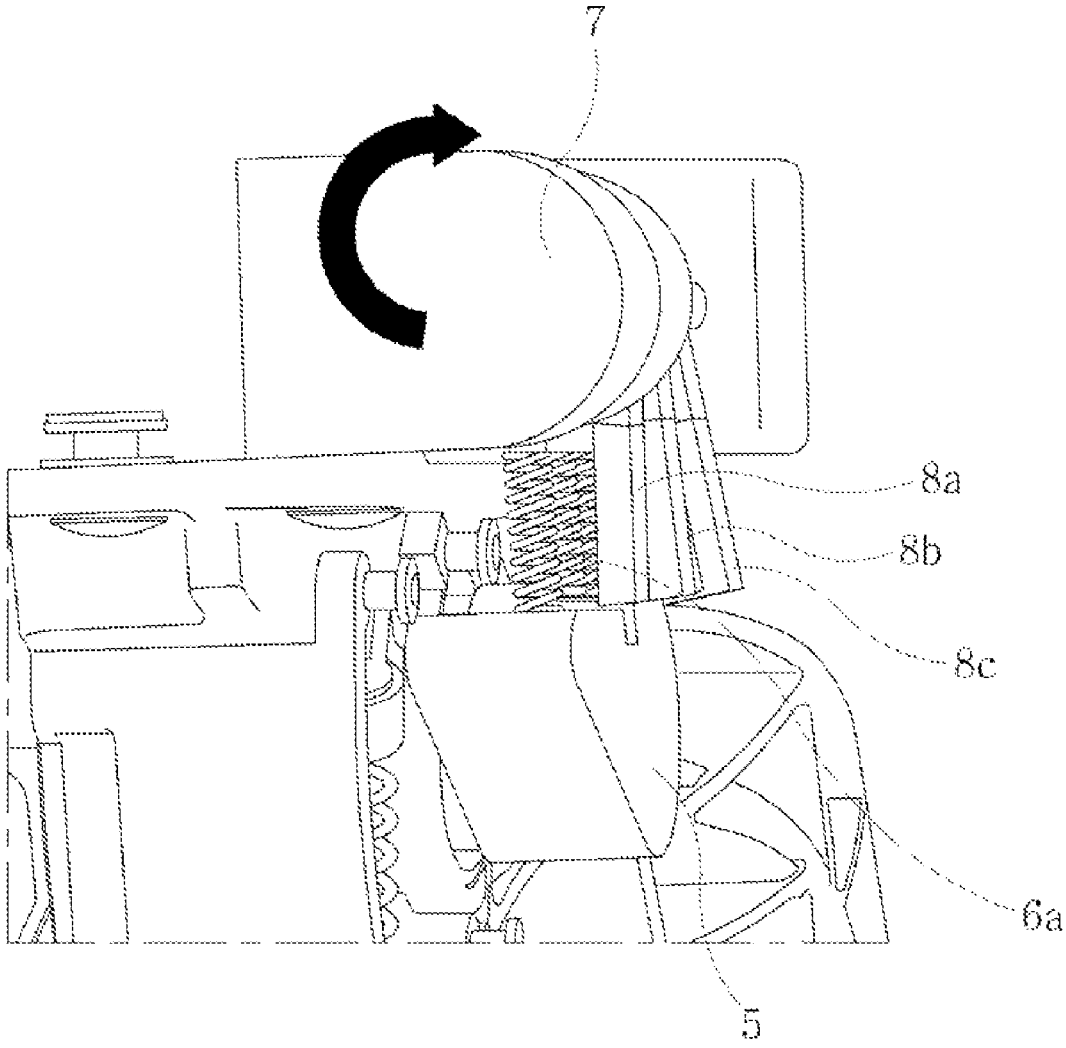
FIG. 3 is a side view of an upper portion in an accelerator pedal device with variable pedal effort according to an exemplary embodiment of the present invention.

While the vehicle travels, the electronic control unit detects in real time the present vehicle speed and the distance from a vehicle ahead using sensors, applies a control electric current to the driving motor to rotate to rotary shaft as shown in detail in FIG. 3, even if the present vehicle speed exceeds a limit speed or the inter-vehicle distance exceeds a limit distance, in which as the rotary shaft rotates, first locking pin 8*a* is first inserted under first compression spring 6*a* and supports first compression spring 6*a*.

Accordingly, the sub-pedal effort provided to the accelerator pedal by first compression spring 6*a* is blocked by the locking pin, such that the pressed amount of the accelerator pedal is restrained and more pedal effort is required to operate the accelerator pedal, and as a result, the pedal effort of the accelerator pedal is changed.

Therefore, a driver feels changes of the pedal effort of the accelerator pedal step by step and recognizes a danger, such that the driver reduces the vehicle speed by reducing the operation stroke of the accelerator pedal such that the vehicle speed does not exceed the limit speed or the inter-vehicle distance increases, and accordingly, a danger of a traffic accident due to overspeed is reduced.

For example, when the present vehicle speed exceeds a predetermined vehicle speed less than 10 km/h, first locking pin 8*a* is inserted under first compression spring 6*a* to lock first compression spring 6*a* by rotation of the motor such that only the pedal effort of first compression spring 6*a* is not transmitted to the accelerator pedal. When the present vehicle speed exceeds the predetermined vehicle speed between 10 km/h and 20 km/h, second locking pin 8*b* is inserted under second compression spring 6*b* to lock second compression spring 6*b* by rotation of the motor such that sub-pedal effort of both of first and second compression springs 6*a*, 6*b* is not transmitted to the accelerator pedal. When the present vehicle speed exceeds the predetermined vehicle speed more than 20 km/h, third locking pin 8*c* is inserted under third compression spring 6*c* to lock third compression spring 6*c* by rotation of the motor such that all the sub-pedal effort of first, second, and third compression springs 6*a*, 6*b*, 6*c* is not transmitted to the accelerator pedal.

As described above, when the locking pins are sequentially pivoted to be inserted under the corresponding compression springs and sequentially support the corresponding compression spring, the pedal effort of the accelerator pedal by the driver in proportionally increased, such that the driver can easily recognize a danger while driving. Further, whether to operate the locking pins is determined by the electronic control unit in accordance with the excess amount from the limit speed and the close amount to the vehicle ahead.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An accelerator pedal device with variable pedal effort, comprising:

an elastic member that applies a restoring force in a return direction to an accelerator pedal rotatably coupled to a vehicle body;

a plurality of compression springs coupled to the vehicle body and providing a pedal effort in an operation direction of the accelerator pedal; and a plurality of locking pins mounted to the vehicle body and being sequentially arranged in a predetermined distance along a longitudinal direction of a rotary shaft of an actuator and fixed at predetermined angle in the circumferential direction on the rotary shaft, so as to be corresponded to the compression springs respectively;

wherein end portions of the each locking pin are integrally connected to a circumference of the rotary shaft of the actuator mounted to the vehicle body and the opposite end portions thereof are sequentially inserted under the each compression spring according to a rotation of the rotary shaft so as to prevent a compression spring engaged with one of the locking pins from increasing the pedal effort.

2. The accelerator pedal device with variable pedal effort as defined in claim 1, further including an electronic control unit that detects a vehicle speed and a distance from a vehicle ahead, and drives the actuator in a case that the vehicle speed exceeds a predetermined vehicle speed and/or the distance from the vehicle ahead exceeds a predetermined inter-vehicle distance.

3. The accelerator pedal device with variable pedal effort as defined in claim 1, wherein a hinge shaft fixed to the accelerator pedal is pivotally connected to a mounting bracket fixed to the vehicle body, wherein the elastic member is disposed between one side of the mounting bracket and one end portion of the accelerator pedal, wherein a pedal effort providing link is integrally connected to the hinge shaft and is disposed along the one end portion of the accelerator pedal, and wherein the plurality of compression springs is positioned between the pedal effort providing link and the other side of the mounting bracket, one end portion of each compression spring being connected to the mounting bracket.

* * * * *